United States Patent [19]

Borst et al.

[11] Patent Number: 4,930,627

[45] Date of Patent: Jun. 5, 1990

[54] RECLOSABLE BLISTER CARD DISPLAY PACKAGE

[75] Inventors: Rodney D. Borst, Oregon; Scott M. Niesen, Madison, both of Wis.

[73] Assignee: Placon Corporation, Madison, Wis.

[21] Appl. No.: 406,137

[22] Filed: Sep. 11, 1989

[51] Int. Cl.[5] ..... B65D 43/16

[52] U.S. Cl. ..... 206/45.23; 206/45.34; 206/470

[58] Field of Search ..... 206/470, 467, 469, 461, 206/45.34, 601, 807, 45.23, 45.24, 806

[56] References Cited

U.S. PATENT DOCUMENTS

| | | | |
|---|---|---|---|
| 3,034,819 | 3/1960 | Tupper | 206/807 |
| 3,111,220 | 11/1963 | Bostrom | 206/462 |
| 3,394,801 | 7/1968 | Hanson . | |
| 3,437,199 | 4/1969 | Jacobson . | |
| 3,448,853 | 6/1969 | Repko | 206/470 |
| 3,463,309 | 8/1969 | Szostek . | |
| 3,581,884 | 6/1971 | Caldwell . | |
| 3,581,885 | 6/1971 | Wald . | |
| 3,746,155 | 7/1973 | Seeley . | |
| 3,783,996 | 1/1974 | Gerard et al. | 206/807 |
| 3,967,730 | 7/1976 | Driscoll et al. . | |
| 4,005,776 | 2/1977 | Seeley . | |
| 4,106,621 | 8/1978 | Sorenson . | |
| 4,146,128 | 3/1979 | Hogg et al. . | |
| 4,155,454 | 5/1979 | Ryden | 206/470 |
| 4,200,193 | 4/1980 | Boyle . | |
| 4,236,637 | 12/1980 | Castner, Sr. et al. . | |
| 4,300,682 | 11/1981 | Kuchenbecker . | |
| 4,308,986 | 1/1982 | Parrilli . | |
| 4,319,684 | 3/1982 | Backman et al. . | |
| 4,360,106 | 11/1982 | Irvine et al. . | |
| 4,378,068 | 3/1983 | Bell . | |
| 4,415,084 | 11/1983 | Hauser et al. . | |
| 4,496,052 | 1/1985 | Nertman . | |
| 4,569,442 | 2/1986 | Bushey | 206/469 |
| 4,687,129 | 8/1987 | Cugley . | |
| 4,724,964 | 2/1988 | Hernandez | 206/470 |
| 4,739,883 | 4/1988 | Mohs et al. . | |
| 4,784,268 | 11/1988 | Perchak . | |

FOREIGN PATENT DOCUMENTS

| | | | |
|---|---|---|---|
| 2124931 | 11/1972 | Fed. Rep. of Germany | 206/467 |
| 1081502 | 8/1967 | United Kingdom | 206/461 |

OTHER PUBLICATIONS

Placon drawing of cube box shaker 2/12/86.
Placon drawing of shaker 12/18/86.

*Primary Examiner*—Jimmy G. Foster
*Attorney, Agent, or Firm*—Lathrop & Clark

[57] ABSTRACT

A reclosable display package of thin flexible thermoformed material with a bubble body for mounting on a backing card is disclosed. The bubble body has continuous top, left and right peripheral flanges, a bottom flange, a front face to the body, and an egress opening in the front face. The reclosable display package includes a cover integral with the body and connected to the body by an integral hinge. The cover is pivotable about the integral hinge to fully close the egress opening in the front face of the package. The cover has a sealant tool opening adapted to permit the passage of a heat or pressure sealing tool through the plastic of the cover to make direct contact with the bottom peripheral flange and seal it to the backing card. The cover may have feet located on either side of the sealant tool opening to support the package in a free standing posture when the cover is closed, or the cover may be rotated about the integral hinge of the package to serve as a rear base and support for display of the package in a rearwardly inclined position with the egress opening uncovered.

15 Claims, 5 Drawing Sheets

RECLOSABLE BLISTER CARD DISPLAY PACKAGE

BACKGROUND OF THE INVENTION

1. Field of the Invention

This invention pertains generally to the field of packaging and containers, and particularly to reclosable display packages with blisters thermoformed from thin flexible plastic material and affixed to card stock bases.

2. Description of the Prior Art

The standard blister package consists of a clear plastic thermoformed bubble or "blister" attached to a backing card by means of an integral flange on four sides. This type of package gives a consumer a clear view of the contents of the package, is economical to produce, and is easy to load, close and ship. Blister packages are particularly well-adapted for containing a number of small articles in one package. However, the prior art blister packages, because they require that the plastic blister be sealed by means of adhesive or heat sealing on all peripheral flanges, tend to be destroyed on the first opening. Where the articles in such packages will not be entirely consumed at the first use it is usually necessary and desirable for the consumer to transfer the articles to a second container if the original container is destroyed or seriously damaged when it is opened.

Prior art blister packages that are reclosable usually require the consumer to cut, tear or deform the package in some way to access the contents. For consumer uses especially, it is desirable that the package not only be openable and reclosable, but that it be openable and reclosable without substantial damage or disfigurement to the package. A package which will be on display in a consumer's home should be attractive, clearly labeled, and provide ready identification of its contents. The prior art is replete with examples of reclosable blister packages but these generally require that the consumer cut or fold the package after purchase in some way. Packages that force the consumer to use separate implements and manually shape the reclosable package are inconvenient and, because they rely on an untrained consumer for final forming, are less consistent and reliable in their reclosable features. Furthermore, prior art packages that are easy to open often achieve this characteristic at the cost of protection to the contents of the package. It is imperative that packages for consumer products, especially those products for human consumption or bodily care, be secure against tampering prior to opening, or that the package give clear evidence of any tampering that may have taken place.

What is needed is a blister card package made from one thermoformed plastic blister that can be easily opened and reclosed without damage to the package, which can be affixed to the backing card in a tamper-resistant fashion, and which can be secured to the backing card while fully loaded.

SUMMARY OF THE INVENTION

A reclosable display package of thin flexible thermoformed plastic material according to the present invention has a bubble body for mounting on a backing card. The body has continuous top, left and right peripheral flanges, a bottom flange, a front face to the body, and an egress opening in the front face.

The reclosable display package further includes a cover integral with the body and connected to the body by an integral hinge. The cover is pivotable about the integral hinge to fully close the egress opening in the front face of the package. The cover has a sealant tool opening adapted to permit the passage of a heat or pressure sealing tool through the plastic of the cover to make direct contact with the bottom peripheral flange and seal it to the backing card.

It is an object of the present invention to provide a blister package with a card stock base and a reclosable cover sealed on all four sides.

It is a further object of the present invention to provide a reclosable blister package with a depending integral hinge adapted to preventing tampering with the contents of the package.

It is further an object of the present invention to provide a blister package with an egress opening that may be covered or exposed by a rotatable cover.

It is a further object of the present invention to provide a blister package with an integral, rotatable cover, that may be sealed to a backing card after loading with articles.

It is an additional object of the present invention to provide a reclosable blister package with a substantially flat front face surface suitable for continuous labeling.

It is also a further object of the present invention to provide a reclosable blister package which may be displayed in a stand-up or a hanging position.

It is a still further object of the present invention to provide a reclosable blister package that may be stood upright by the consumer after the package has been opened to provide convenient access to the package contents.

These objects, and others will become apparent from the following detailed description taken in conjunction with the accompanying drawings showing a preferred embodiment of the invention for exemplification.

DESCRIPTION OF THE PREFERRED EMBODIMENT

Figure 1:
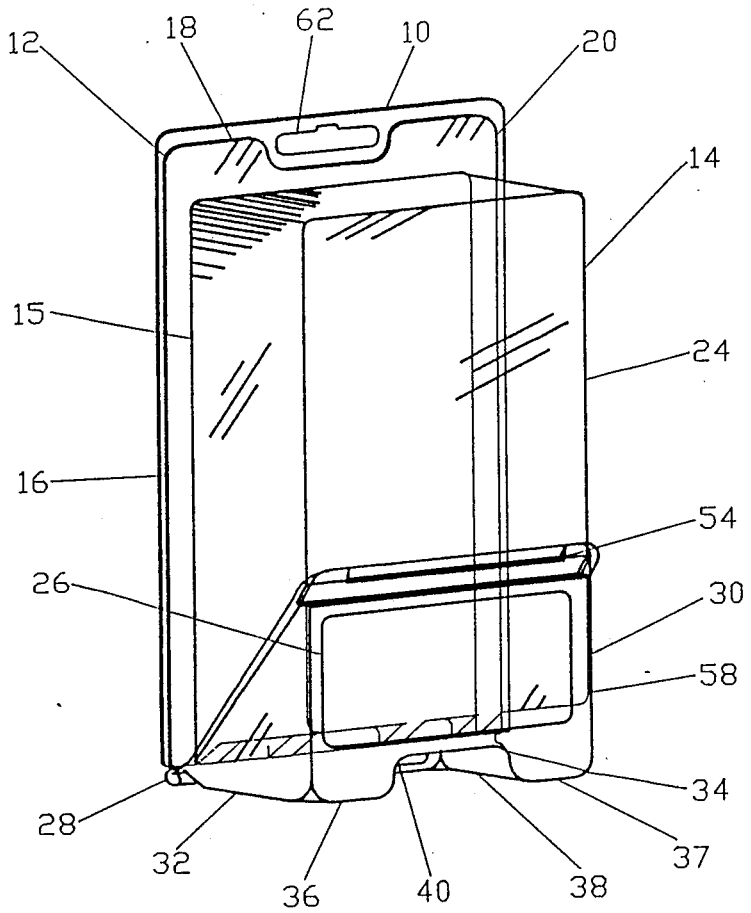
FIG. 1 is a perspective view of a blister card package of this invention, showing the package in the closed position.
Figure 2:
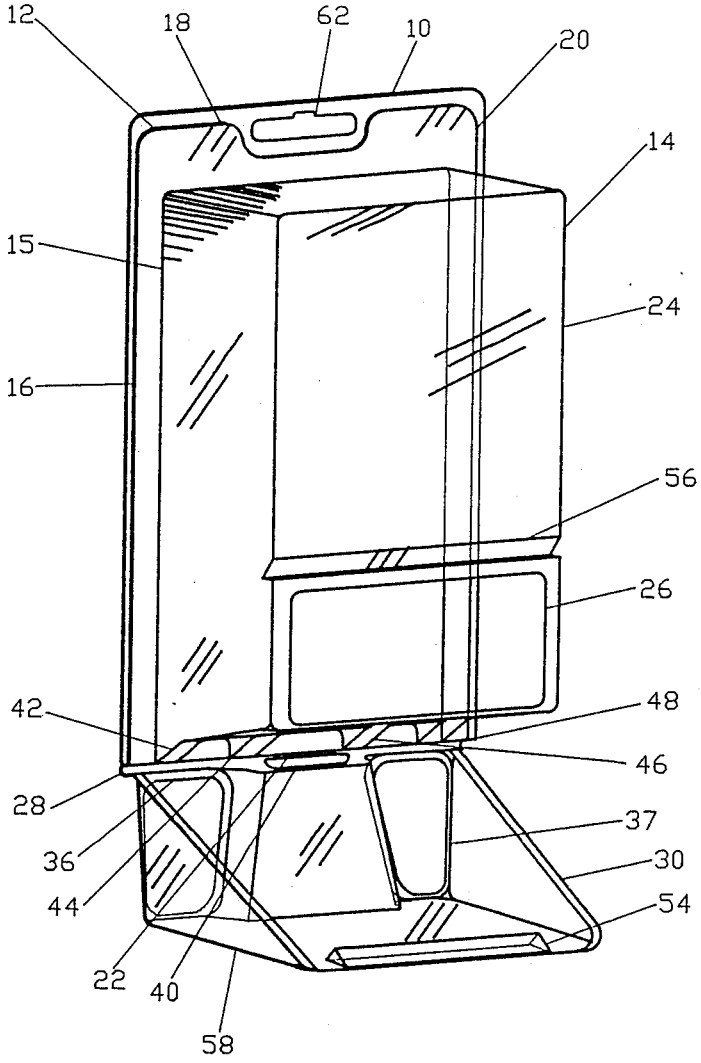
FIG. 2 is a perspective view of the package of FIG. 1, showing the package in the opened position.

Referring more particularly to FIGS. 1–6 wherein like numerals refer to similar parts, the package includes the usual backing card 10 to which is bonded the thermoformed blister 12. The blister includes a bubble body 14 having an article compartment 15, a left flange 16, a top flange 18, a right flange 20, and a bottom flange 22. The body also has a front face 24, and an egress opening 26. Depending from the bottom flange 22 and rotating about an integral hinge 28 is a rotatable cover 30. The cover 30 does not form a part of the body 14 and is independent of the body and is connected only to the bottom flange 22 of the body at the integral hinge 28. The cover preferably has two feet 32, 34 for the purpose of enabling the package to stand up straight. In FIGS. 1 and 2 can be seen the planar base portions 36, 37 of the feet. The planar base portions of the feet are in substantially the same plane as the integral hinge 28 when the cover 30 is closed as in FIGS. 1 and 3. The two feet are positioned on either side of and define an accessway 38 which provides access for a sealant tool to a sealant tool opening 40. By means of this accessway 38 the sealant tool can extend through the sealant tool opening 40 to affix the bottom flange 22 to the backing card 10 when the cover 30 is in a closed position. This feature enables the blister 12, with the cover 30 closed, to be loaded with articles prior to sealing the blister 12 to a backing card 10.

Figure 3:
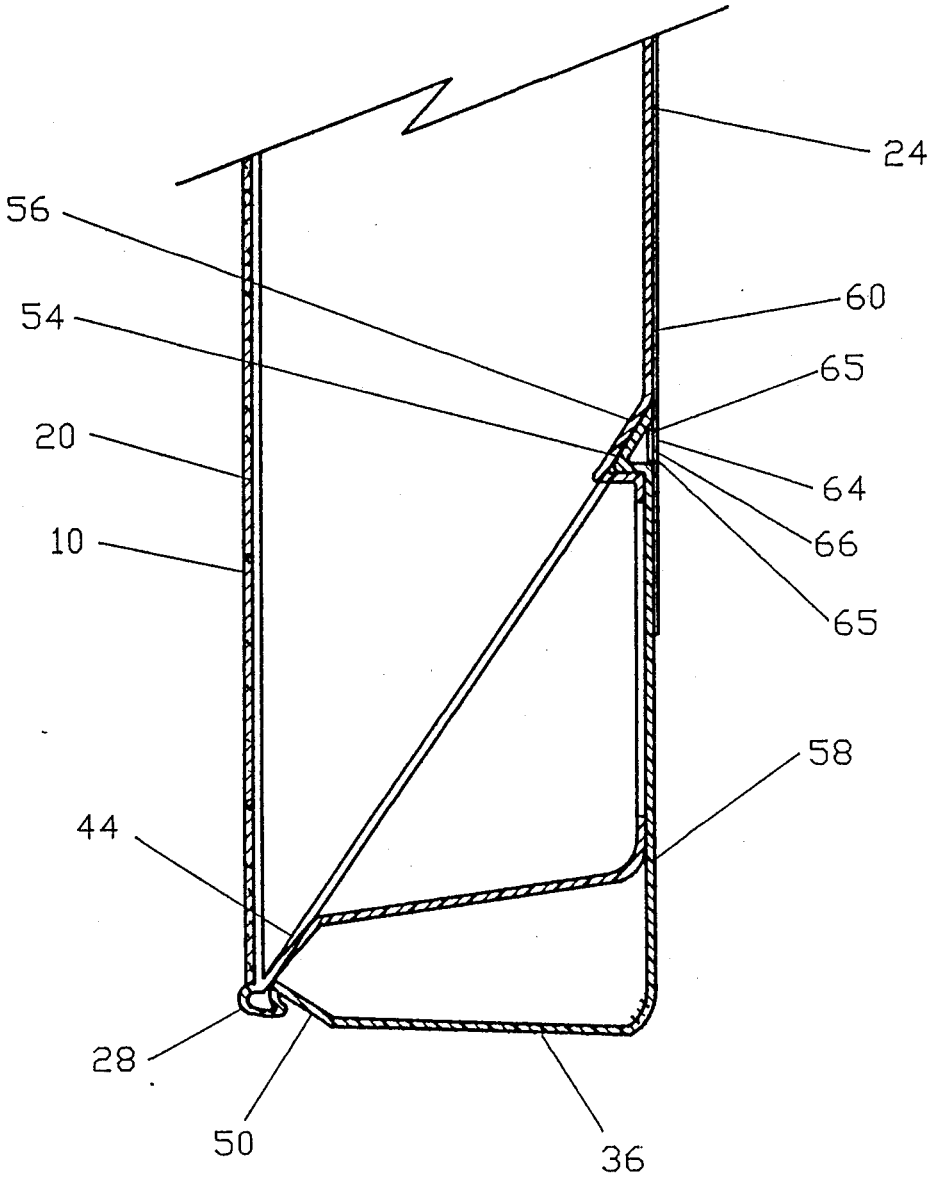
FIG. 3 is an enlarged fragmentary sectional view of the package of FIG. 1 showing the package in a closed position with a tamper-resistant label applied to the front face.

In FIG. 2 can be seen four angled gussets 42, 44, 46, 48 projecting upwardly from the bottom flange 22. These preferred gussets serve to stiffen the body bubble around the egress opening 26 and the bottom flange 22. The gussets also stiffen the bottom flange 22 and assist in retaining the bottom flange against the backing card 10 during and after sealing so as to insure a close and temper-resistant seal along the bottom of the article compartment 15. They also serve to maintain the definition of the integral hinge 28. On the opposite side of the integral hinge from the gussets, and also serving to provide definition to the integral hinge, are the angled set backs 50, 52 of the feet 32, 34 adjacent to the planar portions 36, 37. As shown in FIG. 3, these angled set backs also allow the planar portions of the feet 36, 37 to lie in substantially the same plane as the integral hinge 28 when the package is in an upright, standing position, thereby making it possible for the package to stand vertically. The location and structure of the angled set backs 50, 52 adjacent to the integral hinge 28 particularly serve to stiffen the blister around the integral hinge and prevent excessive distortion of the integral hinge, enabling it to stiffly resist attempts at tampering with the bottom flange 22.

The integral hinge 28 depends from the bottom flange 22 and has a roughly C-shaped cross section providing that when the cover 30 is closed over the egress opening 26 and the bottom flange 22 is affixed to the backing card 10 the length of the integral hinge 28 will extend backwards slightly beyond the plane of the backing card 10. As shown in FIG. 3, the integral hinge 28 thus blocks access to the interior of the body bubble between unsealed portions of the bottom flange 22 and backing card 10, giving added protection against tampering with or contamination of the package contents.

The cover 30 may be repeatedly rotated about the integral hinge 28 to cover or reveal the egress opening 26. The cover is held in the closed position by means of a projecting wedge 54 extending from the cover and a wedge-shaped depression 56 located in the front face 24 above the egress opening 26. The wedge-shaped depression 56 is suited to hold and retain the projecting wedge 54 in snap-fit relation.

To fill the package with articles the cover 30 is first closed over the egress opening 26. As seen in FIG. 3 the front face 58 of the cover and the front face 24 of the bubble body are then in substantially the same plane and adapted to receive a continuous adhesive-backed label 60 either before or after the package is filled. This label serves to seal the package. With the cover in the closed position, the package is filled with articles, the backing card 10 is placed along the thermoformed blister, and the left flange 16, top flange 18, and right flange 20 are affixed to the backing card by heat sealing. The bottom flange 22 is reached by a sealant tool through the sealant tool opening 40 in the cover 30 and also affixed to the backing card 10.

The retailer may now display the package either in a hanging fashion by inserting a hook through display slot 62, or on a shelf in an upright standing position by standing the package on the base composed of the feet 32, 34 and the integral hinge 28. The normally smooth, uninterrupted face of the adhesive label of a displayed package will then readily indicate any tampering with or pilferage of the contents of the package. This resistance to clandestine tampering makes the package particularly suited for health care or cosmetic articles, such as cotton swabs.

The adhesive label 60 for the package may contain an integral tear tab 64 with perforated lines 65 separating the tab from the portions of the label affixed to the front face 24 of the body 14 and the front face 58 of the cover 30. This tear tab 64 overlies the joint formed by the projecting wedge 54 and the wedge-shaped depression 56, and is not affixed to the blister at all due to its backing by a paper backing 66 which also serves to stiffen the tear tab. When the consumer wishes to open the package he simply grasps the extending portion of the tear tab 64 and pulls it across the face of the blister 12, separating the tab 64 from the two remaining portions of the adhesive label 60 along the perforated lines 65. Once the tear tab 64 has been removed the cover 30 may be freely disengaged and rotated.

Alternatively, an adhesive label without a tear tab may be employed. To open the package, the consumer can slit the adhesive label 60 with a sharp object such as a knife, nail file, or fingernail along the joint formed by the projecting wedge 54 and the wedge-shaped depression 56 which acts as a template for breaking any adhesive label applied over the joint. Or, if desired, the label can be perforated along an intended cutline to facilitate use of fingernails to open.

Figure 4:
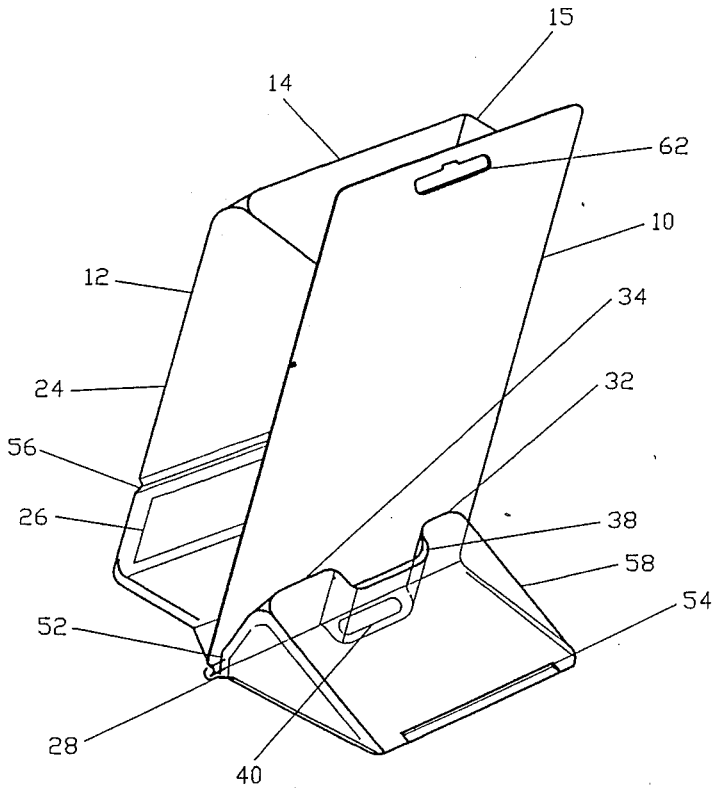
FIG. 4 is a rear perspective view of the package of FIG. 1 shown in an opened, upright, inclined position.
Figure 5:
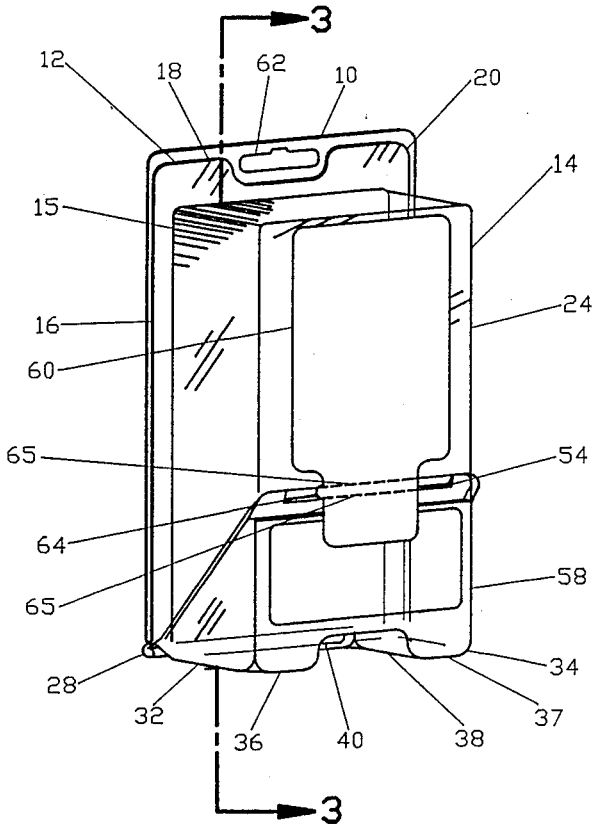
FIG. 5 is a perspective view of the blister card package of FIG. 1 with a tamper-resistant label.

When the consumer folds down the cover 30 there is ready access to the articles contained within the package through the egress opening 26. If the consumer desires, he may fold the cover backwards around the integral hinge 28 until the planar portions of the feet 36, 37 meet the back of the backing card 10. The cover then serves to support the opened package in a backwardly inclined upright position as shown in FIG. 4 for ready inspection of and access to the package contents by consumers.

Figure 6:
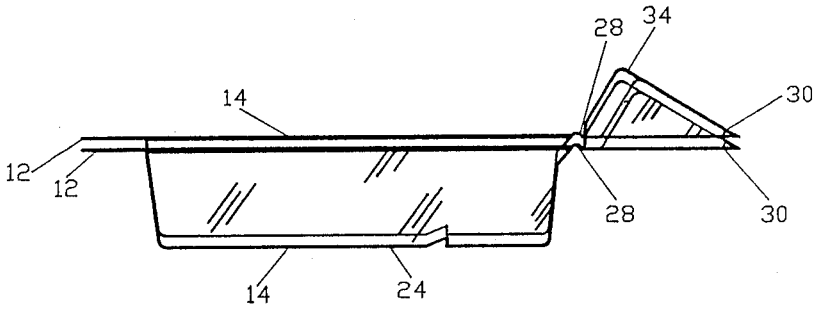
FIG. 6 is a side view of two of the blisters of the invention showing how the blisters may be compactly nested and stacked.

Prior to affixing the backing cards, the thermoformed blisters 12 may be stacked in nested relation as shown in FIG. 6 to provide for compact shipping and storage.

Packages embodying this invention need not contain all the features of the preferred embodiment. Packages of this invention may be formed with more than two feet on the cover, or with no feet at all. The sealant tool opening may be larger or smaller than illustrated or may be absent altogether if the blister is to be sealed to the card with the cover open. There may be two or more sealant tool openings. The cover may be attached at the top or the sides of the package. Or, there may be more than one cover on a package, with a proportionate increase in number of integral hinges and sealant tool openings. The blister bubble may be of a non-rectangular plan, or may be particularly shaped to suit any contents. There may be more than one blister on a card.

Instead of affixing a paper label to the blister face, the plastic of the blister may be imprinted.

It should be understood that this invention is not limited to the particular construction and arrangement of parts herein illustrated and described, but embodies all such modified forms as come within the scope of the following claims.

What is claimed is:

1. A thermoformed blister of flexible plastic material for a reclosable blister card display package comprising:

(a) a bubble body, the body having an article compartment, and top, left, right and bottom peripheral flanges for sealing to a backing card to close the article compartment, a body front face, and portions defining an egress opening in the front face;

(b) a cover integral with the body and connected to a flange of the body by an integral hinge, the cover being pivotable about the integral hinge between a first position in which the cover fully closes the egress opening in the front face and a second position in which the egress opening is fully revealed for unimpeded access thereto, and the cover having portions defining an opening through which a heat sealing tool may contact the connected flange when the cover is in its first closed position to heat seal the connected flange to a backing card; and (c) means formed in the body front face and the cover for releaseably fastening the cover to the front face in the cover first position.

2. The reclosable package blister of claim 1 wherein the cover has two feet, one located on either side of the cover opening, the feet being adapted to support the package in a free standing posture when the cover is in a first closed position.

3. The reclosable display package blister of claim 2 wherein the body peripheral flanges are coplanar and wherein the feet have planar base portions substantially normal to the plane of the flanges when the cover is in its first closed position, and the feet have angled set backs extending outwardly from the integral hinge enabling the planar base portions to be in substantially the same plane as the integral hinge when the package is standing in an upright position and supported by the feet and the integral hinge.

4. The reclosable package blister of claim 1 wherein the connected flange of the body has at least one angled gusset projecting therefrom and the gusset is adapted to stiffen the connected flange and the bubble body and partially define the integral hinge.

5. The reclosable package blister of claim 1 wherein the integral hinge is of a closed C-type structure and wherein portions of the hinge extend beyond the plane of the connected flange so as to block access to the interior of the body beneath the connected flange.

6. The reclosable package blister of claim 1 wherein the means for fastening the cover to the front face comprises a wedge-shaped projection on one of them and portions defining a wedge-shaped depression on the other, the depression being suited to receiving the projection in snap fit relation.

7. The reclosable display package blister of claim 1, wherein the cover may be rotated about the integral hinge away from the front face of the body to serve as a rear base and support for display of the package in a rearwardly inclined position with the egress opening uncovered.

8. The reclosable display package blister of claim 1 wherein the cover has a cover front face, and the body front face and the cover front face are both in substantially the same plane and adapted to receiving a continuous adhesive label when the cover is in its first closed position.

9. The reclosable display package blister of claim 1 wherein the means for fastening the cover to the front face comprises a wedge-shaped projection on the cover and portions defining a wedge-shaped depression on the body above the egress opening, the closed fastening means providing a horizontal joint which provides a template for the breaking of an adhesive label applied to the front face of the body and the cover.

10. The thermoformed plastic blister of claim 1 wherein the blister is affixed to a paperboard backing card at the top, left and right peripheral flanges, and the bottom flange is affixed to the backing card adjacent to the cover opening when the cover is in its first closed position to form an article package.

11. A thermoformed blister of flexible plastic material for a reclosable blister card display package comprising:

(a) a bubble body, the body having an article compartment, and top, left, right and bottom peripheral flanges for sealing to a backing card to close the article compartment, a body front face, and portions defining an egress opening in the front face;

(b) a cover independent of the body and connected to a flange of the body by an integral hinge, the cover being pivotable about the integral hinge between a first position in which the cover overlies a portion of the body and fully closes the egress opening in the front face and a second position in which the egress opening is fully revealed for unimpeded access thereto;

(c) a wedge-shaped projection on the cover;

(d) portions defining a wedge-shaped depression on the body above the egress opening, the depression being suited to receiving the projection, and the projection and the depression cooperating to hold the cover in a position fully blocking the egress opening; and (e) a front face on the cover, the body front face and the cover front face being in substantially the same plane and adapted to receiving a continuous adhesive label when the cover is in its first closed position.

12. The recloseable display package blister of claim 11 wherein the top, left, right and base peripheral flanges are affixed to a paperboard backing card to form an article package.

13. The reclosable package blister of claim 11 wherein the cover has two feet, the feet being adapted to support the package in a free-standing posture when the cover is in a first closed position.

14. A thermoformed blister of flexible plastic material for a reclosable blister card display package comprising:

(a) a bubble body, the body having an article compartment, and top, left, right and bottom peripheral flanges for sealing to a backing card to close the article compartment, a body front face, and portions defining an egress opening in the front face;

(b) a cover independent of the body and connected to a flange of the body by an integral hinge, the cover being pivotable about the integral hinge between a first position in which the cover overlies a portion of the body and fully closes the egress opening in the front face and a second position in which the egress opening is fully revealed for unimpeded access thereto, and wherein the cover has two feet, the feet being adapted to support the package in a free-standing posture when the cover is in the first closed position;

(c) a wedge-shaped projection on the cover;

(d) portions defining a wedge-shaped depression on the body above the egress opening, the depression being suited to receiving the projection, and the projection and the depression cooperating to hold the cover in a position fully blocking the egress opening; and (e) a front face on the cover, the body front face and the cover front face being in substantially the same plane and adapted to receiving a continuous adhesive label when the cover is in its first closed position, wherein the integral hinge is adapted to permit thecover to be rotated away from the front face of the body until the cover feet are in position to engage a backing card peripherally sealed to the peripheral flanges to serve as a rear base and support for display of the package in a rearwardly inclined position with the egress opening uncovered.

15. A thermoformed blister of flexible plastic material for a reclosable blister card display package comprising:

(a) a bubble body, the body having an article compartment, and top, left, right and bottom peripheral flanges for sealing to a backing card to close the article compartment, a body front face, and portions defining an egress opening in the front face;

(b) a cover independent of the body and connected to a flange of the body by an integral hinge, the cover being pivotable about the integral hinge between a first position in which the cover overlies a portion of the body and fully closes the egress opening in the front face and a second position in which the egress opening is fully revealed for unimpeded access thereto, and wherein the cover has two feet, the feet being adapted to support the package in a free-standing posture when the cover is in the first closed position;

(c) a wedge-shaped projection on the cover;

(d) portions defining a wedge-shaped depression on the body above the egress opening, the depression being suited to receiving the projection, and the projection and the depression cooperating to hold the cover in a position fully blocking the egress opening; and (e) a front face on the cover, the body front face and the cover front face being in substantially the same plane and adapted to receiving a continuous adhesive label when the cover is in its first closed position, wherein the body peripheral flanges are coplanar and wherein the feet have planar base portions substantially normal to the plane of the flanges when the cover is in its first closed position, and the feet have angled setbacks extending outwardly from the integral hinge enabling the planar base portions to be in substantially the same plane as the integral hinge when the package is standing in an upright position and supported by the feet and hinge.

* * * * *